United States Patent [19]

Namboodri

[11] 4,193,762

[45] Mar. 18, 1980

[54] TEXTILE TREATMENT PROCESS

[75] Inventor: Chettoor G. Namboodri, North Augusta, S.C.

[73] Assignee: United Merchants and Manufacturers, Inc., New York, N.Y.

[21] Appl. No.: 901,780

[22] Filed: May 1, 1978

[51] Int. Cl.[2] ..... D06B 1/00; D06P 5/00

[52] U.S. Cl. ..... 8/14; 8/151; 8/158; 68/22 R; 68/175; 68/200

[58] Field of Search ..... 8/14, 15, 149, 151, 8/158; 68/13 R, 19.1, 21, 22 R, 22 B, 175, 200

[56] References Cited

U.S. PATENT DOCUMENTS

| | | | |
|---|---|---|---|
| 2,971,458 | 2/1961 | Kumins et al. | 8/62 X |
| 3,255,617 | 6/1966 | Bisang | 68/200 X |
| 3,948,597 | 4/1976 | Sakaoka | 8/149 X |
| 3,954,404 | 5/1976 | Childers et al. | 8/158 X |
| 3,990,840 | 11/1976 | von der Eltz et al. | 8/14 X |

*Primary Examiner*—Philip R. Coe
*Attorney, Agent, or Firm*—Michael S. Caputo

[57] ABSTRACT

A process for the treatment of textile materials, such as woven fabrics, with finishing agents such as dyestuffs, waterproofing materials and the like. The finishing agent is applied in a foam composition to a downwardly moving length of textile material immediately prior to the passage of the material through a pair of horizontally disposed pressure rollers. A predetermined quantity of the foam composition is maintained just prior to the pressure rollers in a dam through which the textile material passes. The pressure rollers break the foam and impregnate the finishing agent into the textile which is thereafter dried and/or cured/or fixed.

9 Claims, 3 Drawing Figures

TEXTILE TREATMENT PROCESS

BACKGROUND OF THE INVENTION

1. Field of the Invention

This invention relates to the field of treating textile materials with fabric finishing agents. More particularly, this invention relates to a novel method of applying fabric finishing agents in a foam composition to textile fabrics.

2. Description of the Prior Art

Conventionally, the treating of textile fabrics with finishing agents, e.g., coloring agents or dyes, resins, and the like, has involved a procedure wherein the finishing agent is either dissolved or dispersed in a suitable liquid medium, such as an aqueous or organic liquid, and then the mixture of the finishing agent and liquid medium are applied to the fabric. Because of the relatively large amounts of liquid medium associated with this process which must be removed from the fabric, the use of foam carriers has been proposed.

One such process is described in the co-pending application Ser. No. 584,389, filed June 6, 1975 and now U.S. Pat. No. 4,118,526 for a Method of Treating Fabrics of which I am a co-inventor. There, an amount of the finishing agent effective to produce the desired finishing effect on the fabric is incorporated in a foamable composition capable of forming a stable foam having a blow ratio in the range of from about 2:1 to about 20:1. The composition is converted to a foam and coated onto the fabric by means of a knife and is thereafter compressed, padded or vacuumed to break the foam and to achieve penetration of the foam through the fabric. The so-treated fabric is then dried, if necessary, cured or fixed in a conventional manner. Other foam related processes have utilized other means to apply the coating onto the fabric.

SUMMARY OF THE INVENTION

An object of the present invention is to provide an improved method of applying the foam onto the fabric and one which has the ability to produce various novel effects.

The foregoing is accomplished by a process wherein a foam containing one or more finishing agents is applied to at least one side of a length of a downwardly moving textile material immediately prior to the passage of the textile material through a pair of horizontally disposed pressure rollers. The foam composition is maintained in a dam disposed along the path of travel of the textile material at a point prior to or upstream of the pressure rollers. The foam composition is applied to the textile material as it passes the dam in which a predetermined amount of the foam composition is maintained. The pressure rollers serve to break the foam and to impregnate the finishing agent into the textile material.

In another embodiment of this invention, a foam containing one or more finishing agents is applied to both sides of a textile material just prior to the passage of the textile material through the horizontally disposed rollers. Different finishing agents may be applied to each side of the fabric in order to produce a different effect on each side of the fabric.

Usage of the process disclosed herein is advantageous in that it produces uniform coating without the necessity of knife coating or other provision to regulate the coating height. Furthermore, because the fabric is capable of being treated on each side, simultaneously, uniform front to back dyeing is achieved. Such process also facilitates the application of different treating agents to both sides of the fabric and allows for increased production rates in the treatment of woven and knitted or pile fabrics.

DETAILED DESCRIPTION OF THE INVENTION

Figures 1, 1A:
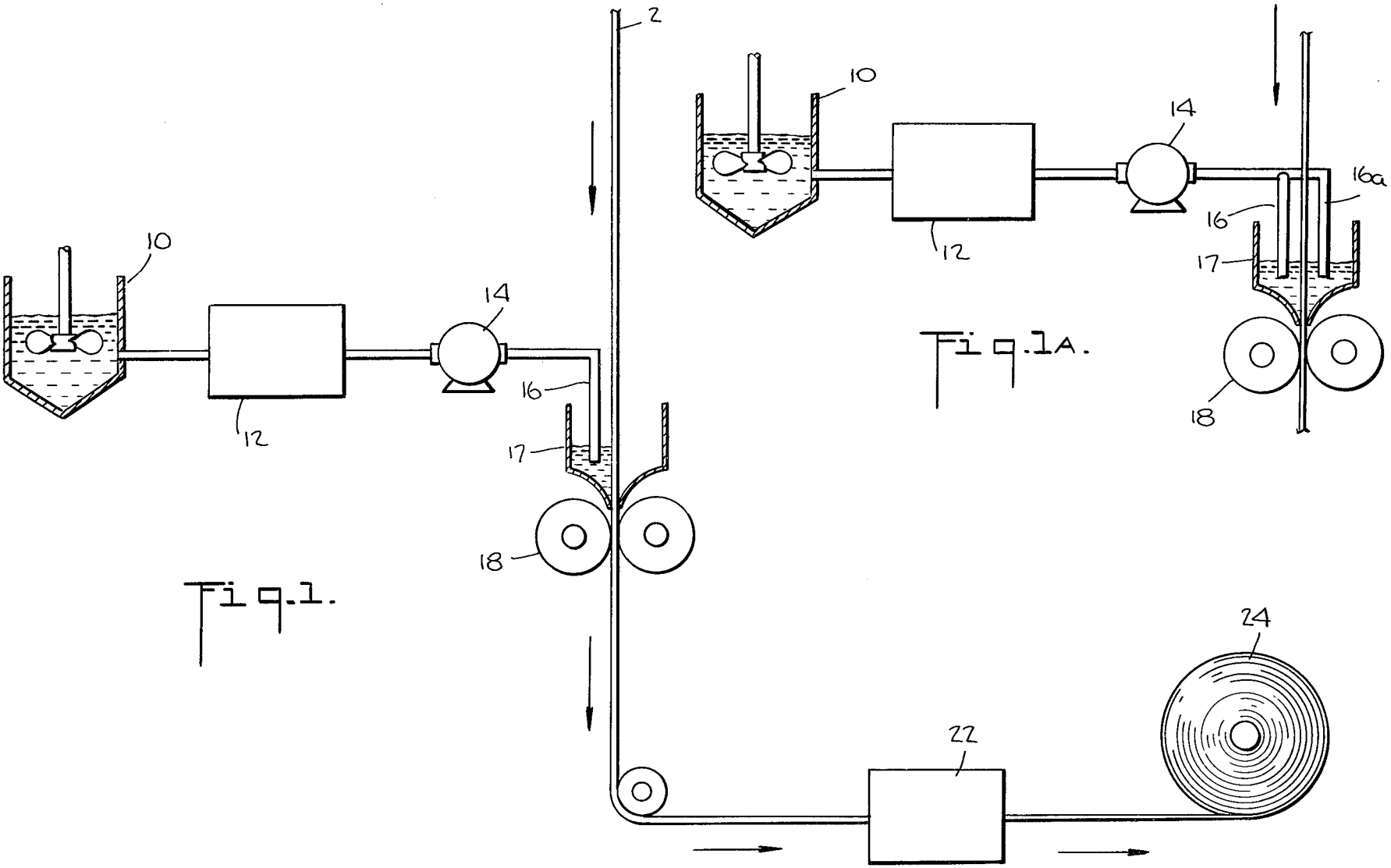
FIG. 1 is a schematic diagram illustrating the process of the present invention.
FIG. 1A is a partial schematic diagram illustrating the application of the foam composition to both sides of a textile material.

Referring to FIG. 1, the fabric finishing agent is applied to one side of a textile material as follows. Textile material 2 is conveyed from an appropriate source in a descending direction by suitable conveying means and after treatment wound onto a take-up roll.

In mixing tank 10, a composition comprised of a liquid diluent and finishing agent is first mixed. The foam stabilizer is added to the mixture at mixing tank 10 to form a foamable composition. The foamable composition is then routed to a mechanical foamer 12. The foam composition as referred to herein is understood to include foam stabilizers such as those referred to in my earlier referenced application as well as any others suitable for use in applying finishing treatments as described herein. Also, auxiliary foam stabilizers and thickeners such as those of a type described in my earlier application, may be incorporated in the foam composition.

The composition, after foaming, is transferred through line 16 by pump 14 and applied onto fabric 2 just prior to the fabric's passage through the nip of horizontally disposed pressure rollers 18 to one side or both sides of fabric. A predetermined quantity of foam composition is maintained in the dam 17 which is located immediately prior to the nip of the pressure rollers 18. Preferably the foam composition is maintained in a constant supply by means of level controls. At the base of the collector is an opening which allows the foam composition to float into the nip of the pressure rollers 18. Passage of the fabric 2 through the foam filled dam 17 results in a quantity of foam composition to be applied onto the fabric. The thus coated fabric passes through rollers 18 at which the foam is compressed to collapse the bubbles and to impregnate the finishing agent throughout the fabric.

When it is desired to impart the same treatment to both sides of the fabric 2, line **16*a*, which is an extension of line 16, is provided to supply foam composition to the other side of dam 17 as illustrated in FIG. 1A. Passage of fabric 2 through the foam containing dam 17** thus results in a quantity of foam composition to be applied onto both sides of the fabric.

When the treatment requires complete penetration of the finishing agent, the pressure to which the coated fabric 2 is subjected by the horizontally disposed rollers 18 should be sufficient to insure penetration of the foamed composition throughout the fabric. Generally, pressures of from about 2 to 500 pounds per linear inch are adequate for such treatment and preferably the pressures are from about 2 to 100 pounds per linear inch.

After the compression step, the impregnated fabric is routed through a drying means 22 to remove any residual water or organic liquid. Subsequently, the fabric may be subjected to fixing or curing steps depending on the nature of the finishing agent. Alternatively the drying and fixing steps can be combined at 22. After the fixation or curing treatment, the fabric may be subjected to conventional after treatments, e.g., rinsing, oxidation, etc., and then wound up for subsequent use on take up roll 24.

Figure 2:
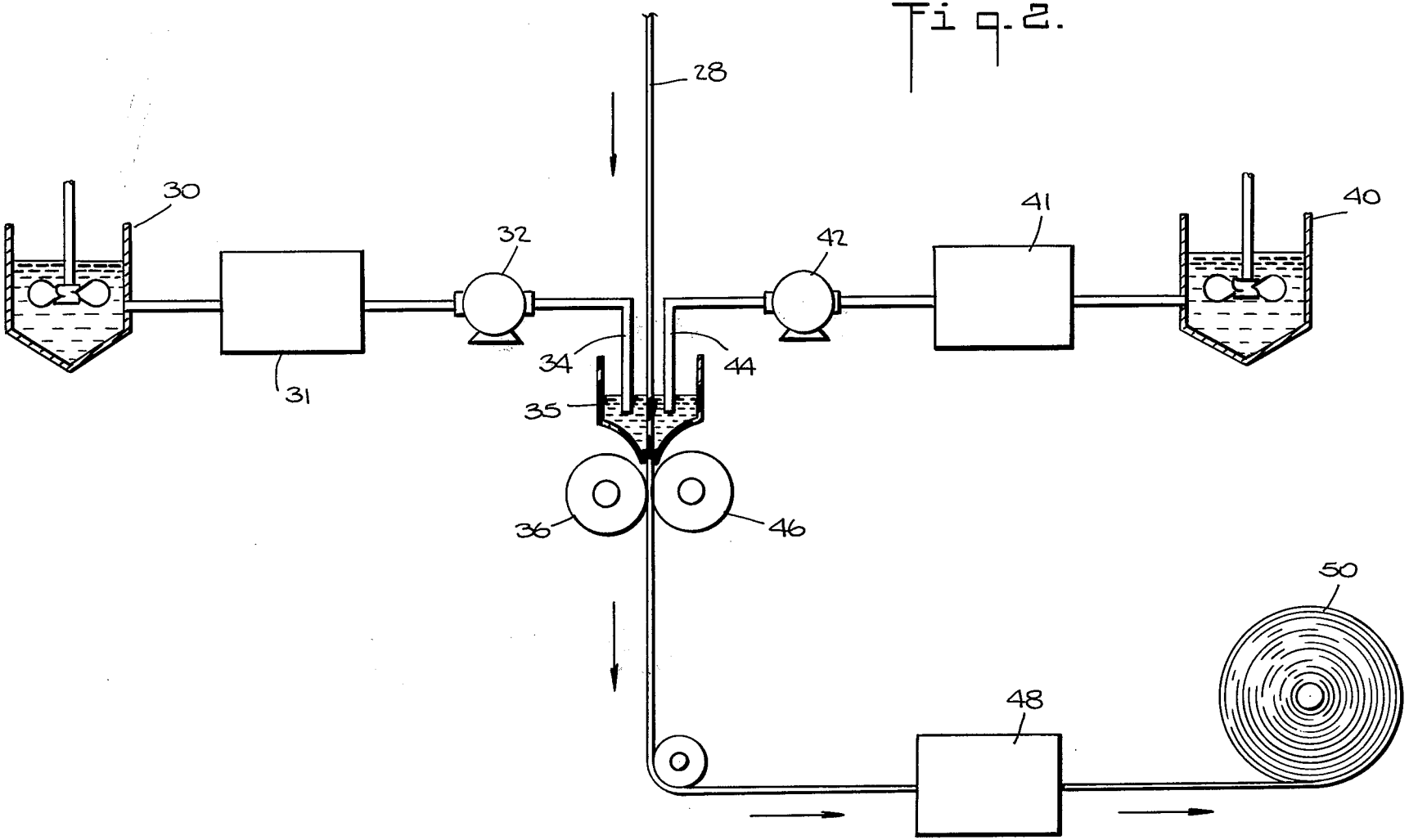
FIG. 2 is a schematic diagram illustrating another embodiment of this invention.

Fabric 2, as shown in FIGS. 1 and 2 is in a vertical descending path. Of course, prior to passage through the foam containing dam 17, fabric 2 may originate from a horizontal, non-descending path. However, at the point of application of the foam thereto, the fabric is required to be turned and routed in a downward vertical direction.

A method for treating both sides of a textile material or fabric by the use of two foamers is shown in FIG. 2. Fabric 28 is fed from an appropriate source in a descending path toward the horizontally disposed pressure rollers 36 and 46. Simultaneously, compositions including a liquid and finishing agent are mixed in mixing tanks 30 and 40. The finishing agent may be the same or a different agent for each composition. For example, mixer 40 may contain a coloring agent while mixer 30 contains a waterproofing agent, or each mixer may contain different coloring agents.

Also, one mixer may contain a coloring agent for application to one side of the fabric while the other mixer may contain the developer for application to the other side of the fabric.

After mixing, the mixture including the foam stabilizer as before is routed to mechanical foamer 31 or 41. The resulting foams from the foamers 31 and 41 are passed through lines 34 and 44 by pumps 32 and 42, respectively, and coated on both sides of fabric 28 just prior to passage of the fabric through rollers 36 and 46. The foam coating is applied by passing the fabric through dam 35 in which a supply of the foaming composition is maintained. As discussed, a different foaming composition may be maintained on opposite sides of the fabric 28. The coated fabric then passes through pressure rollers 36 and 46 where the foams are collapsed and the finishing agent or agents contained therein are impregnated into the fabric. The impregnated fabric then passes through drying means 48 to remove any residual water or organic liquid. A curing or a fixation step is used as desired and the fabric 28 is wound on take-up roll 50.

In the foregoing embodiment, where the same foam composition is to be applied to both sides of the fabric, it is possible to utilize only one of the mixers 30 or 40 and foamers 31 or 41 to supply lines 34 or 44 in a manner such as indicated in FIG. 1A.

As used herein, reference to finishing agents is intended to collectively include both coloring agents, e.g., dyes, pigments and the like, color developers, e.g., acid developers for rapidogen colors, alkali as a developing agent for reactive dyes or a reducing agent for vat dyes as well as agents which are used to treat fabrics to impart various properties to the fabric, e.g., water repellants, antistatic agents, weighting agents, durable press agents, soil release agents, softening agents, fire retardant agents, and the like.

Thus, there has been described a process wherein foam may be applied directly to a textile material without the need for a knife coating or other provision to regulate the coating height. Moreover, special effects heretofore not achieveable are now capable of being produced with foam finishing techniques.

Although the above description is directed to a preferred embodiment of the invention, it is noted that other variations and modifications will be apparent to those skilled in the art and, therefore, may be made without departing from the spirit and scope of the present disclosure.

What is claimed is:

1. A process for applying a finishing treatment to a textile material which comprises forming a stable foam composition which includes said finishing agent therein;

routing said textile material downwardly in a substantially vertical path through a pair of horizontally disposed pressure rollers;

maintaining a predetermined amount of said foam composition in a dam disposed along the vertical path of travel of said textile material at a point upstream of said pressure rollers;

routing said textile material in the proximity of said dam to apply said foam composition to at least one side of said downwardly moving textile material at a point prior to the passage of said textile material through said horizontally disposed pressure rollers;

and forcing the foam on the surface of the vertically disposed textile material into the material and collapsing the foam by means of said pressure rollers to effect penetration of said foam into said fabric.

2. The process according to claim 1, wherein said predetermined amount of foam composition is maintained substantially constant in said dam.

3. The process according to claim 1 wherein said finishing agent comprises a coloring agent.

4. The process according to claim 3 wherein said foam is applied to both sides of said downwardly moving textile material.

5. The process according to claim 4 wherein a foam containing a different color agent is applied to each side of said textile material to produce a textile material having different colors on the front and back thereof.

6. The process according to claim 4 wherein a foam containing a coloring agent is applied to one side of said textile material and a foam containing an agent different therefrom is applied to the other side of said textile material.

7. The process according to claim 4 wherein a foam containing a coloring agent is applied to one side of said textile material and a foam containing developer is applied to the other side of said textile material.

8. The process according to claim 1 wherein the pressure applied to said foam containing textile material by said horizontally disposed pressure rollers is in the range of from about 2 to about 500 pounds per linear inch.

9. The process according to claim 1 wherein said foam composition is applied to said textile material at a point immediately prior to the nip of said horizontally disposed pressure rollers.

* * * * *